United States Patent [19]

Kindred

[11] 4,059,273

[45] Nov. 22, 1977

[54] WORD GAME HAVING A BOARD AND A PLURALITY OF PIECES

[75] Inventor: Michael Kindred, Bilborough, England

[73] Assignee: Invicta Plastics Limited, England

[21] Appl. No.: 752,512

[22] Filed: Dec. 20, 1976

[51] Int. Cl.[2] ..... A63F 3/00

[52] U.S. Cl. ..... 273/130 R

[58] Field of Search ..... 273/130 A, 130 E, 130 D, 273/130 R, 131 G, 131 AD, 131 AB, 131 BA; 35/35 H

[56] References Cited

U.S. PATENT DOCUMENTS

| | | | |
|---|---|---|---|
| 1,286,157 | 11/1918 | Vizcarra | 273/130 E |
| 2,058,079 | 10/1936 | Heath | 273/130 D |
| 3,126,205 | 3/1964 | Jordan | 273/130 R |
| 3,545,761 | 12/1970 | Brooks et al. | 273/130 E |

OTHER PUBLICATIONS

"And Now, Master Mind," Time Magazine, 12/1/75, p. 73.

*Primary Examiner*—Richard C. Pinkham
*Assistant Examiner*—Arthur S. Rose
*Attorney, Agent, or Firm*—Diller, Brown, Ramik & Wight

[57] ABSTRACT

The invention provides a board game designed to test the logical thinking of two players. The game comprises a board having twenty six rows of playing areas arranged in columns, into which playing pieces may be placed in an attempt to break a hidden code. The rows are numbered A – Z and the attempts are scores according to the nearness to an accurate guess by the player. The code has five such letters forming a word, one letter per column.

5 Claims, 1 Drawing Figure

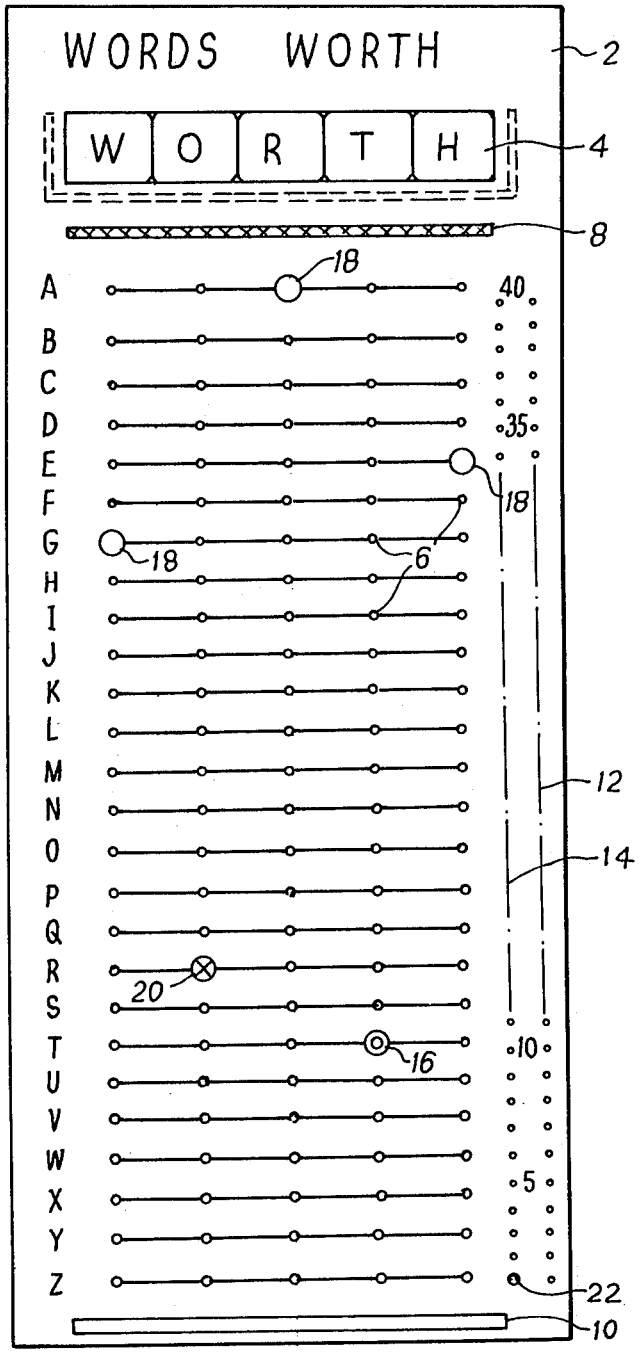
WORDS WORTH
2
W O R T H
4
8
18
A
B
C
D
E
F
G
H
I
J
K
L
M
N
O
P
Q
R
S
T
U
V
W
X
Y
Z
40
35
18
18
6
12
14
20
16
10
5
22
10

WORD GAME HAVING A BOARD AND A PLURALITY OF PIECES

BACKGROUND OF THE INVENTION

The invention relates to a board game for two players which has been devised so as to exercise their powers of logical thinking. In playing the game, a first player sets the second player a problem to solve, the roles of the players being periodically reversed, and the number of attempted solutions are totalled after a pre-determined series of games, the lesser of the two totals providing the winner.

BRIEF DESCRIPTION OF THE INVENTION

The invention therefore provides a board game comprising a board having a reserved area adapted to display a target word selected by a first player, a shield capable of hiding the target word from the view of a second player, said board being further provided with a playing area composed of a plurality of rows and columns of playing positions, the number of the rows corresponding to the number of letters in the alphabet being used and each row being identified by a letter of that alphabet, the end portion of the playing area bearing the first part of said alphabet having an identifying characteristic and the end portion of the playing area bearing the last part of the alphabet having a contrasting characteristic, a plurality of test playing pieces each identical with one another, a plurality of first marker pieces having said first identifying characteristic and a plurality of second marker pieces having said second characteristic.

Conveniently, the reserved area may have a wipe-clean surface of plastics material upon which may be written the letters of the target word. Advantageously, the area is divided into sub-areas each designed to display one letter of the word and to lie at the head of a column of playing positions, the number of columns corresponding to the maximum number of letters in the chosen target word.

Conveniently, the end portions of the playing areas may be identified by their colour characteristic, for example, a "a black end" and a "white end".

In playing the game, the first player will select, for example, a five-letter word and will write the letters in the reserved area and put the shield in place. The second player will think of a likely word and will spell it out across the columns in the playing area by placing a test playing piece in the appropriately lettered row of each column.

The first player will then mark the attempt by taking each column in turn and either i. leaving a correctly placed test playing piece in position;

ii. replacing a test playing piece which is placed too near the "black end" by a white marker piece; or iii. replacing a test playing piece which is placed too near the "white end" by a black marker piece.

The invention will now be described in detail with reference to the accompanying drawing, which shows a board as it appears after one attempt has been made to identify a target word. It wll be understood that the description is given by way of example only and not by way of limitation.

The board 2 is provided with a reserved area 4 having a wipe-clean surface on which, in the drawing, has been written the target word "WORTH".

The area 4 is divided into five sub-areas, each lying at the head of one of five columns of playing positions in the form of apertures 6, arranged in twenty-six rows, each identified by a letter of the alphabet.

At the top end portion of the playing area is a strip 8 which is black in colour and at the lower end portion is a strip 10, which is white.

At the right hand margin of the board are two columns of numbered apertures 12, 14, which serve as a means to record the number of attempts made by the two players (one per column) to solve a pre-selected equal number of words according to the following rules.

The second player attempts a guess as to the hidden target word and in his first attempt spells out the word "GRATE" with his test playing pieces, which are, in the present example, yellow pegs 16, inserted in the appropriate apertures.

The first player now marks the attempt. In the first column the correct letter was "W" which is further toward the "white end" of the board than the trial letter "G", so the yellow peg is removed and replaced by a white marker peg 18. Similarly, white markers are used to replace the yellow pegs in the third and fifth columns, "R" and "H" being nearer the white end than are "A" and "E".

However, in the second column, the correct letter "O" is nearer the "black end" than is the trial letter "R", and therefore the first player replaces the yellow peg in the "R" aperture by a black marker peg 20. The trial peg in the fourth column is, however, in the correct aperture, "T", and therefore remains in place.

The drawing illustrates the board as it appears at this stage of the game. One scoring peg 22 is inserted to indicate one player has made one attempt.

The second player then makes a further attempt using a word which has a "T" in fourth position, but has its first letter after "G" in the alphabet, its second letter before "R", and its third and fifth letters after "A" and "E" respectively. All playing pegs and marker pegs are retained in position until the correct word is set up.

The second player then writes out a word in the reserved area 4 and the number of attempts of the first player to guess it correctly are noted in the second scoring column 14.

After a predetermined number of words have been set by each player, say three or four, the number of attempts made are compared in the two scoring columns, and the lower of the two totals provides the winner of that series of games.

Alternatively, the player whose score first exceeds the number of places in the column (forty in the present example) is the loser.

I claim:

1. A board game comprising a board having a reserved area adapted to display a target word selected by a first player, a shield capable of hiding the target word from the view of a second player, said board being further provided with a playing area composed of a plurality of rows and columns of playing positions, the number of the rows corresponding to the number of letters in the alphabet being used and each row being identified by a letter of that alphabet, the end portion of the playing area bearing the first part of said alphabet having an identifying characteristic and the end portion of the playing area bearing the last part of the alphabet having a contrasting characteristic, a plurality of test playing pieces each identical with one another, a plurality of first marker pieces having said first identifying characteristic and a plurality of second marker pieces having said second characteristic.

2. A board game as claimed in claim 1 wherein the reserved area has a wipe-clean surface of plastics material.

3. A board game as claimed in claim 1 wherein the reserved area is divided into sub-areas, each sub-area being arranged at the head of a column of playing positions.

4. A board game as claimed in claim 1, wherein the end portions of the playing areas are identified by their colour characteristics.

5. A board game as claimed in claim 5 wherein one end portion of the playing areas is identified as black and the other as white.

* * * * *